United States Patent [19]

Gibson et al.

[11] 4,191,793

[45] Mar. 4, 1980

[54] METHOD OF FORMING A DURABLE CREASE

[75] Inventors: James D. M. Gibson, Ilkley; Paul Hageman, Bradford, both of England

[73] Assignee: Wool Development International Limited, London, England

[21] Appl. No.: 907,058

[22] Filed: May 17, 1978

Related U.S. Application Data

[63] Continuation of Ser. No. 841,672, Oct. 13, 1977, abandoned.

[51] Int. Cl.[2] ..... A41D 1/10

[52] U.S. Cl. ..... 427/276; 427/286; 427/288; 427/370; 427/390 C; 38/144; 223/28

[58] Field of Search ..... 223/28, 29, 33–36, 223/38; 156/176, 311, 312; 427/230, 390 C, 275, 276, 288, 286, 238, 369, 370

[56] References Cited

U.S. PATENT DOCUMENTS

| | | | |
|---|---|---|---|
| 2,603,612 | 7/1952 | Elissabide | 260/23 |
| 3,510,972 | 5/1970 | Thompson | 38/42 |

FOREIGN PATENT DOCUMENTS

| | | | |
|---|---|---|---|
| 683955 | 4/1964 | Canada | 156/176 |
| 3320 | 2/1970 | Japan | 156/312 |

*Primary Examiner*—Ralph S. Kendall
*Attorney, Agent, or Firm*—Harold L. Stowell

[57] ABSTRACT

A durable crease is formed in a textile article by applying a flexible casting compound in a preformed crease using a non-rotary applicator in conjunction with a structure for guiding the applicator along the crease.

1 Claim, 10 Drawing Figures

METHOD OF FORMING A DURABLE CREASE

CROSS-REFERENCE TO RELATED APPLICATIONS

This application is a continuation of application Ser. No. 841,672 filed Oct. 13, 1977, now abandoned and related subject matter is disclosed and claimed in application Ser. No. 906,973 Gibson et al filed May 17, 1978 which is a continuation of application Ser. No. 841,671, Gibson et al, filed Oct. 13, 1977, and now abandoned.

BACKGROUND OF THE INVENTION

This invention relates to a method of forming durable creases and a fluid dispensing apparatus therefor.

U.S. applications Ser. Nos. 664,898 Mar. 8, 1976 and 685,127 filed May 10, 1976, each now abandoned disclose methods of forming a durable crease in a textile article in which a temporary crease is formed in the article, a rotary applicator is supplied with a liquid adhesive composition that sets to a solid insoluble in water and dry-cleaning solvents, and the applicator is guided along the temporary crease to deposit a line of the liquid composition in the apex of the crease before final hot pressing.

This process gives long-lasting creases stable to dry-cleaning, but under certain conditions of moisture and mechanical action the crease may become less well defined. Also, the requirement for a pre-pressing and a final pressing step does not always fit well into clothing production lines since additional steam presses may be needed.

BRIEF DESCRIPTION OF THE INVENTION

We have now discovered that by using certain casting compounds, preferably in conjunction with a non-rotary applicator, the final hot-pressing step can be omitted without adverse effect on the quality and durability of the crease, thus saving a processing step. Furthermore, the creases may be improved in durability, particularly under conditions of moisture and mechanical action.

According to the present invention there is provided a method of forming a durable crease in a textile article which comprises forming a temporary crease of the desired sharpness in the article, and applying a flexible casting compound into the apex of the crease from an applicator guided along the crease whereby the shape of the crease is durably preserved when the casting compound has set.

Preferably the casting compound is a natural or synthetic material which sets or cures to a flexible, rubbery substance insoluble in water or dry-cleaning solvents. Advantageously, the amount of compound used is sufficient to fill the apex of the crease to a depth of from ¼ to 2 millimeters, preferably about 1 mm. Much more than this will produce creases the appearance of which resembles the sewn-in creases sometimes employed with jersey fabric trousers; much less and the 'casting' effect will be insufficient. The compound may be a curable latex or a curable thiol, polyurethane or silicone rubber, preferably the latter.

The silicone compositions which it is preferred to apply in the process of the invention are those which cure to a soft, flexible, insoluble rubber-like material. Such compounds are commercially available for a number of end-uses, e.g. as caulking compounds. Particularly useful compounds are available under the tradenames Silastic RTU (Dow Corning) or Silcoset 151, 152 and 153 (ICI). The curing of such compounds is believed to be in the nature of a chemical cross-linking and is therefore irreversible.

The curing takes place at room temperature and it is preferred to keep the textile article folded flat along the crease line for the duration of the curing period.

It has been found that the amount of casting compound to be used is greater than the amount of adhesive used in the processes of our earlier applications, but the properties of the compound are such that durable and aesthetically pleasing creases can be obtained without a final pressing step.

In our earlier applications various types of rotary applicators are disclosed. We have found that the process of the present invention is preferably carried into effect using an applicator which at the point of application of the compound to the textile is non-rotary, in order to deliver sufficient compound into the apex of the crease.

To carry out the method of the invention, there is provided a fluid dispensing apparatus for applying fluid to a surface which comprises a fluid reservoir, a nozzle connected therewith, a rotatable member engageable with the surface and means responsive to rotation of the member for urging fluid from the reservoir through the nozzle.

The rotatable member preferably engages the textile article on either side of the crease line, whereby the nozzle may be guided in the apex of the preformed crease. To this end the nozzle is preferably of non-circular cross-section particularly towards it dispensing extremity, and may advantageously be formed as a slit. The speed of rotation of the member determines the rate of egress of fluid from the nozzle, and accordingly the amount of compound deposited in the crease (measured for example in g/m) is independent of the speed of passage of the apparatus along the crease.

In our U.S. applications there is disclosed a guiding system comprising a surface having a channel contoured to receive the crease of a pre-creased textile article whereby the article can be supported and contained in the area of the crease during application of adhesive. The process and apparatus of the present invention may be used with advantage with this guiding system.

The reservoir of the present dispenser is preferably a replaceable 'throw-away' cartridge and may conveniently be a moulded plastics material hypodermic syringe body. Such bodies are available commercially in large numbers and are therefore very inexpensive.

In this case the nozzle may be adapted from, or fitted to, the nozzle already formed in the syringe body.

The means responsive to rotation of the member preferably comprises a worm gear arrangement designed to urge a plunger into the reservoir as the member rotates. In order that the nozzle should not ooze fluid after use owing to excess pressure existing within the reservoir, means for retracting the plunger a small way may be provided which can be operated at the end of each run. Complementary means for inducing an initial pressure in the reservoir at the beginning of each run may also be provided.

While the dispensing apparatus will find its greatest use in performing the process of the invention, it is not so limited, and may be used for any purpose where it is desired to apply a line of fluid of controlled density.

A preferred aspect of the apparatus provides a stand carrying a spaced pair of elongate support arms or platforms, each arm being adapted to receive one leg or pair of trousers, and the arms optionally being rotatable as a pair through at least 180°.

The arms or platforms are conveniently adapted to receive a pre-creased pair of trousers turned inside-out and each preferably has a longitudinal channel or slot contoured to receive the crease and stabilizing the trousers so that the applicator can be run along the inner apex of the crease quickly and accurately. Advantageously, the underface of each of the arms or platforms also carries an equivalent slot or channel so that, on rotation through 180°, the underside creases of the trousers can be treated. The trousers are then turned right way out, and pressed to fix the crease.

Preferably the platforms are smooth to allow swift handling.

Thus the device enables very quick handling of each pair of trousers on equipment having a very low capital cost.

It will be appreciated that alghough the method is applicable to all textile articles, its principal use will be for permanently creasing trousers.

The textile articles to be durably creased may be in the form of garments, e.g. pleated skirts, or trousers. The fabrics or garments may be made of any fiber or blend of fibers, natural or synthetic, but it is envisaged that the process will be principally applicable to the non-heat-settable natural fibers, e.g. cellulosics and keratinous fibers, and especially wool. The fabrics or garments may be woven, knitted or non-woven. The invention is particularly useful with fabric constructions, e.g. knitted structures, in which it has hitherto been difficult to form a durable crease.

BRIEF DESCRIPTION OF THE DRAWINGS

The invention will be described further, by way of example only, with reference to the accompanying drawing, in which.

Figure 2:
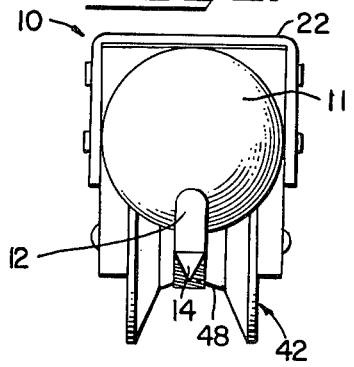
FIG. 2 is an end view of the dispensing apparatus taken in the direction II in FIG. 1.
Figure 3:
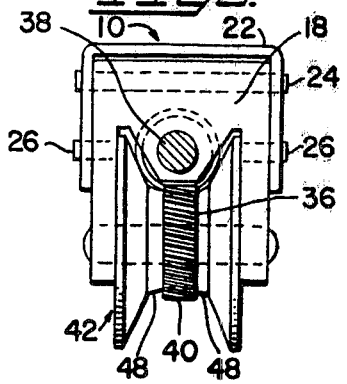
FIG. 3 is an end view of the dispensing apparatus taken in the direction III in FIG. 1.

As shown in the drawings, the dispensing apparatus 10 comprises a reservoir 11 in the form of a moulded plastics hypodermic syringe body having a nozzle 12. The nozzle 12 is threaded and screwed onto it is a fish-tail nozzle-end 14 which, as can be seen from FIG. 2, is flat and presents a slot-shaped exit for the contents of the reservoir 10. The reservoir 10 is push-fitted or screwed onto a shaped plastics block 16. A second plastics block 18 is a sliding fit in cylindrical recess in the block 16 and is biassed outwardly by a compression spring 20. A metal cover 22 pivotally attached to the block 16 by a pin 24 holds the second block 18 in place by trapping pegs 26 which extend from the second block 18, in recessed portions 28 of the cover 22. The shape of the recessed portions 28 is such that the pegs 26 will normally locate in their lowest corners unless the cover is pivoted downwardly, when the pegs will ride up the adjacent inclined surfaces 32 and urge the second block 18 further into the recess in the block 16.

The second block 18 is formed with a recess 34 which carries an internally threaded and externally toothed gear wheel 36. A threaded rod 38 is engaged with the internal thread of the gear wheel 36, while the latter engages externally a worm dirve 40 which forms part of a rotatable member 42 having two outer flanges 46 and two inner rubber surfaces 48. Thus when the member 42 is rotated the gear wheel 36 is rotated and the rod 38 moves axially, relative to the block 18.

At the extremity of the threaded rod 38, within the reservoir 10, is a tightly slidably fitted seal 50 carried on a former 52, designed to sweep the contents of the reservoir 10 towards the nozzle 12.

Figure 1:
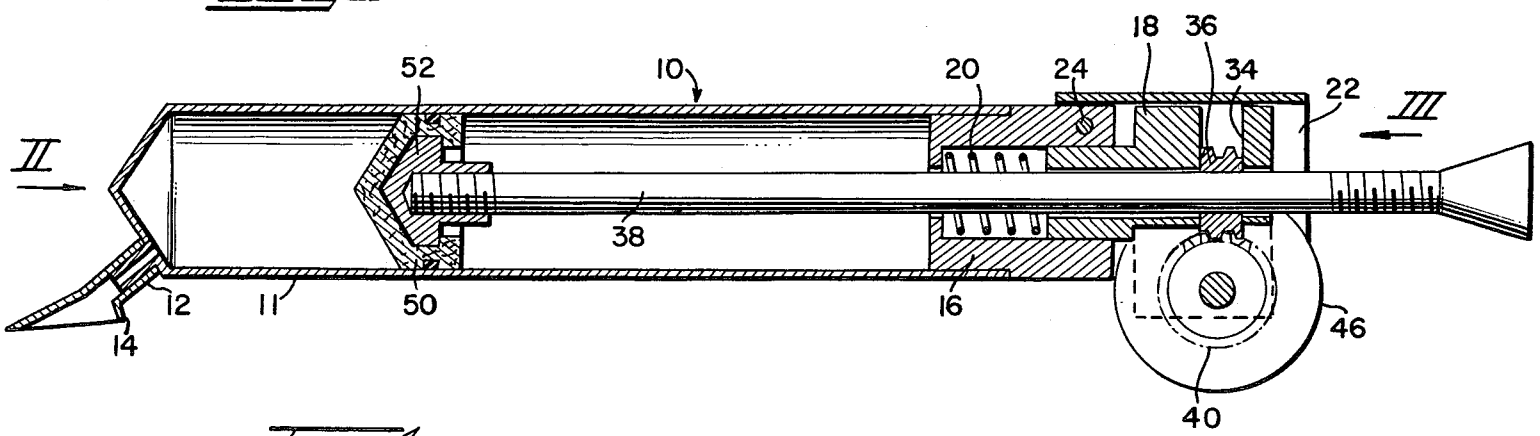
FIG. 1 is a longitudinal sectional view of a dispensing apparatus according to this invention.

In use the reservoir fluid 10 is filled with fluid, for example a curable silicone rubber compound, and the block 16 fitted thereto with the treaded rod and seal assembly screwed up close to the block. On engaging the rotatable member 42 with the surface to which the fluid is to be applied, the cover 22 is depressed into contact with the second block 18, forcing the peg 26 up the inclined surfaces 32 to the position shown in FIG. 1 and slightly pressurizing the fluid in the reservoir, so bringing it to the orifice of the nozzle. The nozzle is positioned as desired and the apparatus moved by rolling on the rotatable member 42, which revolves and thus drives the threaded rod 38 and the seal 50 through the reservoir, expressing fluid from the nozzle-end 14 in an amount proportional to the speed of rotation of the member 42. When the desired line of fluid has been laid the apparatus is lifted from the surface and the pressure on the cover 22 released. The spring acting through the second block 18 and pegs 26 forces the latter down the surfaces 32 to the lowest corners of the recesses 30, causing the rod 38 and seal 50 to withdraw slightly and depressurize the reservoir 10 and thereby preventing unwanted oozing of fluid from the nozzle end 14.

Figure 4:
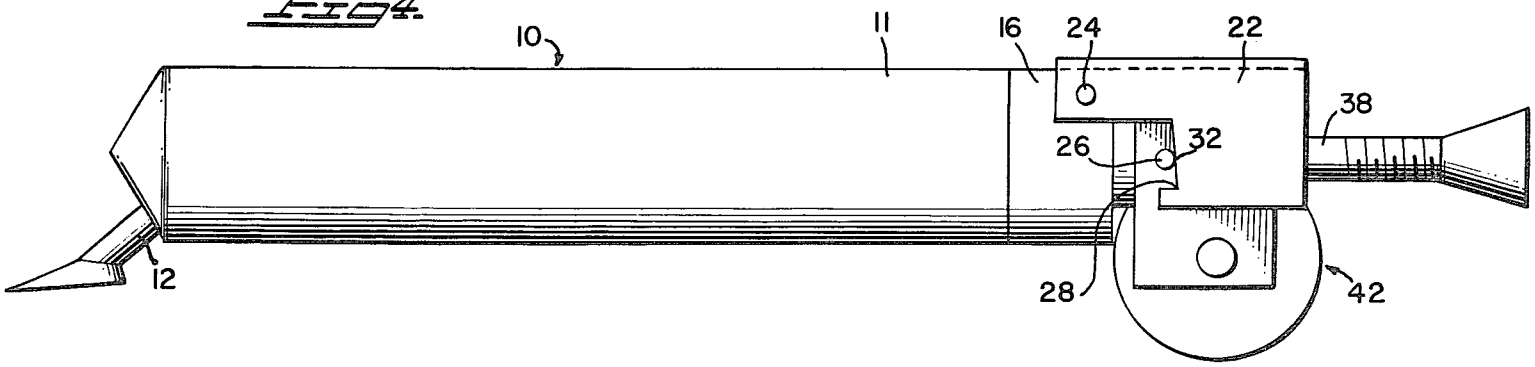
FIG. 4 is a view similar to FIG. 1 showing further details.

As shown in FIG. 4, a knurled knob 54 may be provided on the end of the rod 38 to assist the operative in pre-loading the plunger when a new adhesive cartridge (i.e. reservoir 10) is fitted to the operating mechanism.

Figure 5:
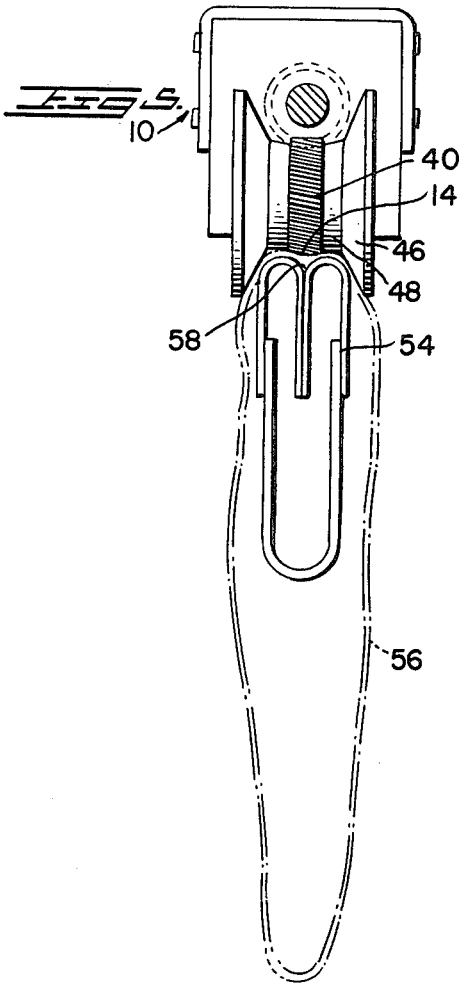
FIG. 5 is a cross-section through the dispensing apparatus.

The apparatus of the invention is particularly useful for performing the creasing process of the invention, especially in conjunction with the apparatus now to be described with which it is specifically designed to cooperate. FIG. 5 shows the combination in use, with a grooved support arm 54 supporting a trouser leg 56, turned inside out, which bears a temporary crease 58 and is engaged by the apparatus 10. The flanges 46 of the rotatable member 42 fit on either side of the upper part of the support arm 54, and the rubber surfaces 48 rest on the trouser fabric on either side of the crease line 58. The worm drive 40 is thus held clear of the fabric. The nozzle end 14 can be directed right into the apex of the crease to give a very accurate application of silicone compound to the pre-creased trousers, which are then removed from the arm 54, turned right way out, and laid flat to allow the compound to cure.

Trousers so treated have creases of good appearance, durable to wear, dry-cleaning and washing.

Figure 6:
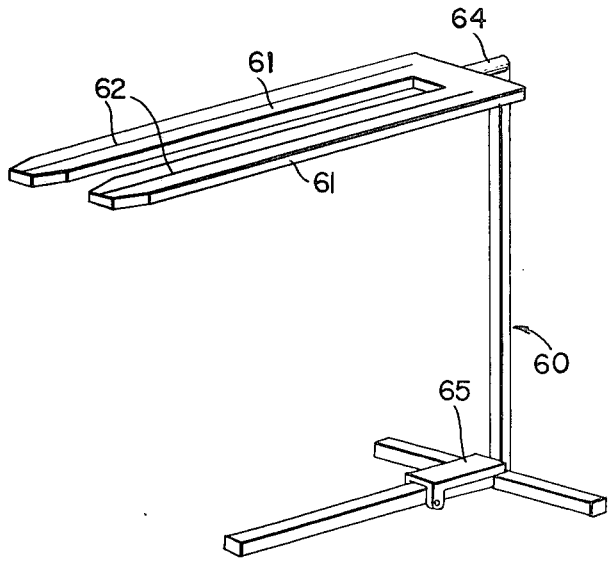
FIG. 6 is a perspective view of a stand for a textile article according to the invention.
Figure 7:
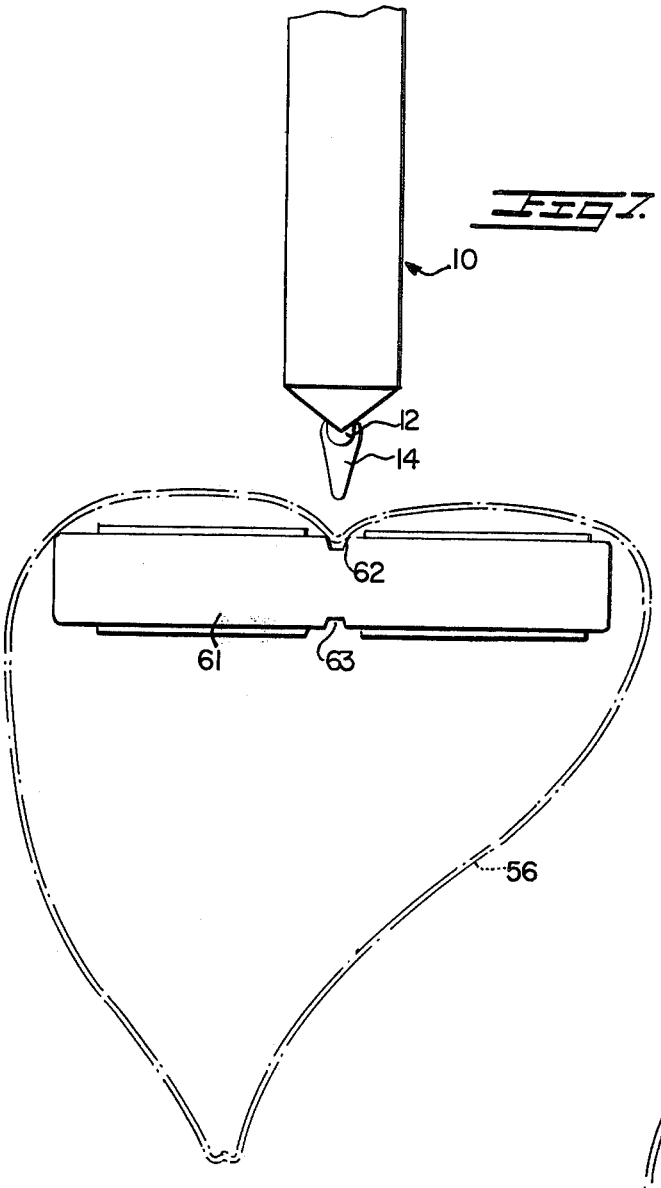
FIG. 7 is a fragmentary cross-section of the stand of FIG. 6 in combination with an adhesive applicator.

FIG. 6 shows a simple form of device according to this invention suitable for use in creasing trousers. An upright stand 60 carries a pair of elongate platforms 61 partly tapered at the tip, each capable of receiving the leg of a pair of trousers. The platforms 61 each have in their surface a central channel or groove 62 adapted to receive a creased portion of a trouser leg. Similar channels 63 may be provided on the opposite faces of the platforms 61, as shown in FIG. 7. The same figure also shows a suitable applicator 10 in the operative position in relation to the channel 62. A trouser leg inside-out and in position for the application of adhesive by the applicator is shown in chain dotted lines at 56. In this position the adhesive applicator 10 can be run accurately along the inner apex of the crease. The platforms 61 may pivot at 64 through 180°, for example on operation of a foot pedal 65, in order that the underneath creases may be treated.

With the embodiment of FIGS. 6 and 7 it may be desirable to clamp or otherwise restrain the trouser legs alongside the grooves 62. For example a relatively heavy template or stencil may be placed over the trouser leg, or it may be physically clamped by conventional methods, e.g. by means of load-spreading strips and G-clamps. An alternative method of temporarily restraining the trouser leg is to use light ferro-magnetic restraining plates in conjunction with magnets or electromagnets within the platforms 61 to clamp the trouser leg 56 by the force of magnetic attraction. Switching off the electromagnets enables the lightweight plates to be handled and positioned easily.

Figure 8:
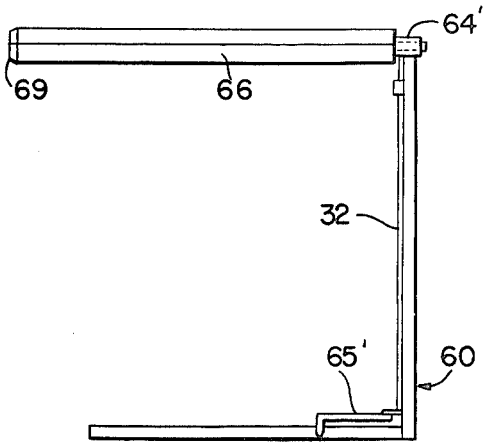
FIG. 8 is a side elevation of another and preferred form of stand.
Figure 9:
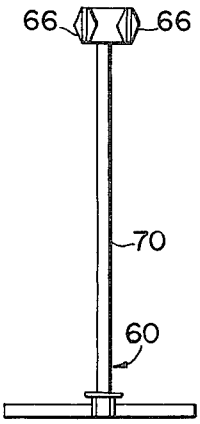
FIG. 9 is an end elevation of the stand of FIG. 3.
Figure 10:
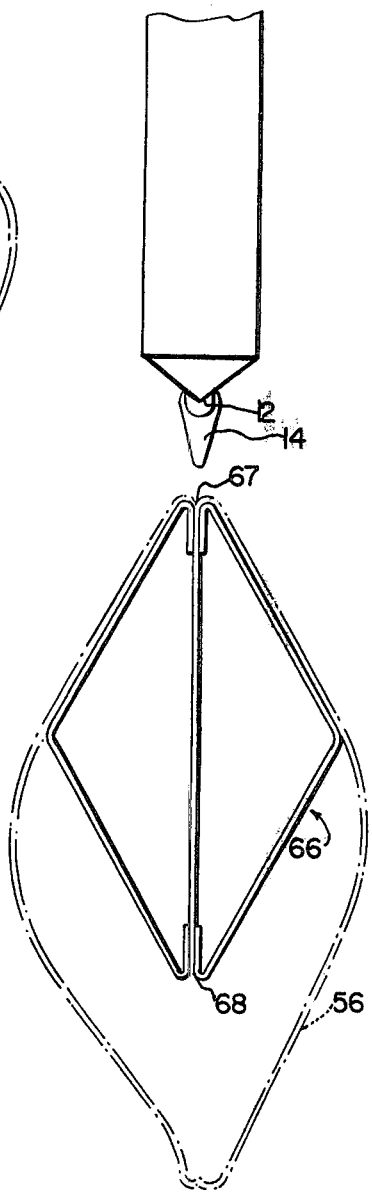
FIG. 10 is a cross-section similar to FIG. 7 but showing the stand of FIG. 8.

FIGS. 8, 9 and 10 illustrate a preferred form of device according to the invention with which external means of restraining the trouser legs is normally unnecessary. A stand 60 similar to that of FIG. 6 carries support arms 66 which are diamond shaped in cross-section and have channels 67 and 68 at their upper and lower apices. The free ends of the support arms 66 are tapered at 69 to facilitate the passage of trouser legs over them. The latter are indicated at 56 in position in FIG. 10, which also shows an applicator 10 in its operative position. The profile of these support arms in such that trouser legs 56 drape over them and the frictional contact between the material and the platform is sufficient to provide restraint and prevent the trouser legs rucking up during application of adhesive. The support arms can be rotated together through 180° about the mounting 64' by operation of foot pedal 65' through a push rod 70 to enable the lower creases on the trouser legs 56 to be brought to the top for engagement with the lower channels 68 without removing the trousers from the support arms 66.

What we claim is:

1. A method for producing durable creases in a pair of trousers which comprises:

providing at least one elongated support structure of dimensions to fit within and at least the length of a trouser leg;

providing said structure, on each opposed upper and lower face, with a channel adapted to receive a preformed crease of a said trouser leg;

providing said support structure with a rotatable mounting so that the position of said faces may be reversed;

turning the pre-creased legs of a said trouser inside out and positioning one said turned leg on said structure whereby the length of the apex of the upper located creases lies within the associated channel;

providing the dispenser head with a slot operatively conforming to the received crease of the turned leg;

operatively associating said dispenser with the positioned leg and traversing said crease to dispense said resin therein;

rotating said support structure 180° whereby to present the opposed crease to said dispenser and dispensing said resin along the length of said opposed crease;

removing said leg from the support structure; and turning said leg inside out; and folding the leg flat and curing the resin whereby to form said durable crease.

* * * * *

REEXAMINATION CERTIFICATE (1395th)

United States Patent [19] [11] B1 4,191,793

Gibson et al. [45] Certificate Issued Dec. 25, 1990

[54] METHOD OF FORMING A DURABLE CREASE

[75] Inventors: James D. M. Gibson, Ilkley; Paul Hageman, Bradford; William V. Morgan, Burley in Wharfedale; Brian Robinson, Ilkley, all of England

[73] Assignee: Wool Development International Limited, London, England

Reexamination Request:
No. 90/001,920, Dec. 22, 1989

Reexamination Certificate for:

| | |
|---|---|
| Patent No.: | **4,191,793** |
| Issued: | **Mar. 4, 1980** |
| Appl. No.: | **907,058** |
| Filed: | **May 17, 1978** |

Related U.S. Application Data

[63] Continuation of Ser. No. 841,672, Oct. 13, 1977, abandoned.

[51] Int. Cl.[5] ..... A41D 1/10

[52] U.S. Cl. ..... 427/276; 427/286; 427/288; 427/370; 427/393.2; 38/144; 223/28

[58] Field of Search ..... 427/230, 238, 275, 276, 427/286, 288, 369, 370, 393.2; 118/32; 156/176, 311, 312; 38/144; 223/28, 29, 33–36, 38

[56] References Cited

U.S. PATENT DOCUMENTS

| | | | |
|---|---|---|---|
| 1,734,516 | 11/1929 | Foulds . | |
| 2,253,732 | 8/1941 | Segelin . | |
| 2,600,783 | 6/1952 | Kropa . | |
| 2,603,612 | 7/1952 | Elissabide | 2/227 X |
| 2,739,908 | 3/1956 | Marsh . | |
| 2,974,432 | 3/1961 | Warnock . | |
| 3,096,524 | 7/1963 | Mizell . | |
| 3,268,915 | 8/1966 | Warnock . | |
| 3,498,740 | 3/1970 | Cain . | |
| 3,510,972 | 5/1970 | Thompson | 38/42 |
| 3,663,159 | 5/1972 | Gordon . | |
| 3,687,605 | 8/1972 | Farmer . | |
| 3,722,000 | 3/1973 | Rossell . | |
| 3,983,269 | 9/1976 | Pearson . | |
| 3,984,367 | 10/1976 | Pearson . | |

FOREIGN PATENT DOCUMENTS

| | | | |
|---|---|---|---|
| 813541 | 4/1974 | Belgium . | |
| 664442 | 6/1963 | Canada . | |
| 683955 | 4/1964 | Canada | 156/176 |
| 880161 | 9/1971 | Canada . | |
| 535947 | 10/1931 | Fed. Rep. of Germany . | |
| 683680 | 8/1938 | Fed. Rep. of Germany . | |
| 1419060 | 10/1969 | Fed. Rep. of Germany . | |
| 801701 | 5/1936 | France . | |
| 852737 | 11/1939 | France . | |
| 2173770 | 10/1973 | France . | |
| 2208021 | 6/1974 | France . | |
| 2225564 | 11/1974 | France . | |
| 111103 | 1/1975 | German Democratic Rep. . | |
| 42-19397 | 9/1967 | Japan . | |
| 45-3320 | 2/1970 | Japan | 156/312 |
| 6703851 | 9/1967 | Netherlands . | |
| 7316056 | 5/1974 | Netherlands . | |
| 7405017 | 10/1974 | Netherlands . | |
| 173946 | 7/1976 | New Zealand . | |
| 74/2097 | 3/1975 | South Africa . | |
| 165010 | 6/1921 | United Kingdom . | |
| 291473 | 6/1928 | United Kingdom . | |
| 291474 | 6/1928 | United Kingdom . | |
| 453230 | 9/1936 | United Kingdom . | |
| 527598 | 10/1940 | United Kingdom . | |
| 540086 | 10/1941 | United Kingdom . | |
| 605982 | 8/1948 | United Kingdom . | |
| 823789 | 11/1959 | United Kingdom . | |
| 839516 | 6/1960 | United Kingdom . | |
| 894129 | 4/1962 | United Kingdom . | |
| 1060808 | 3/1967 | United Kingdom . | |
| 1259595 | 1/1972 | United Kingdom . | |
| 1289133 | 9/1972 | United Kingdom . | |
| 1472852 | 5/1977 | United Kingdom . | |

OTHER PUBLICATIONS

"A Water-Repellent Crease-Resistant Finish, Silicone Alloy-Triazone Combination," Agricultural Research Service, USDA, (Aug. 1963) Connor.

"Abrasion-Resistant DP Cottons," *Textile Industries*, Sep. 1966, pp. 107–124.

"All-Wool Permanent-Press Fabrics Part III: Stabilization of Set with N, N' Dimethylolurea, All Wool Permanent-Press Fabrics, Part III, Etc., *Textile Institute and Industry*, pp. 29–36 (1968), DeBoos and J. Delmenico.

"Application of Solvent-Soluble Resins to Wool," IWS, Applied Polymer Symposium No. 18, 1971, T. D. Brown and T. Shaw.

"*Crease Resistant and Water Repellent Cotton from Dimethylolethyleneureapolysiloxane Emulsion Treatment," American Dyestuff Reporter, May 28, 1962, pp. 29–33 by Beninate, Drake, Guthrie.*

"Creasing and crease-resistance of all-wool fabrics" in Textile Manufacturer, Feb. 1964, p. 76, A. N. Davidson.

"Cross-Linked Silicone Films as Wash-Wear, Water-Repellent Finishes for Cotton," Bullock, (May 1965).

"Cross-Linked Silicone Films in Textile Finishing," pp. 324–333, *Textile Research Journal*, vol. 37, No. 4 (Apr. 1967), Clark M. Welch, Joel B. Bullock, Matthew F. Margavio.

"Crosslinking Cotton Cellulose with Glyoxal Reaction Products," *American Dyestuff Reporter*, Feb. 10, 1969, pp. 27–29, Ellwood J. Gonzalez and John D. Guthrie.

"Development of a Permanent Press for 100% Wool Woven Fabrics," *Textile Manufacturer* (Oct. 1972) Dr. T. Shaw.

"Dialdehydes as Cotton Cellulose Cross-Linkers," *Textile Research Journal*, Mar. 1958, pp. 257–262 by Melvin D. Hurwitz and Lawrence E. Conlon.

"Dramatic Advances in Textile Technology," (Feb. 1976 (IWS).

"Durable crease system launch", *Drapers Record*, Jul. 17, 1976.

"Durable creasing system", *Manufacturing Clothier*, Oct. 1976.

"Durable Trouser Crease", *Textile Manufacturer & Knitting World No. 5,* Jul. 1976.
"Durable Water Repellency by Chemical Bonding of Silicones," Gilkey (Feb. 1963).
"Easy trouser crease", *Apparel News,* Jul. 23, 1976.
"Economical, durable trouser crease developed by IWS", *International Dyer,* Jul. 9, 1976.
*Encyclopedia of Polymer Science and Technology,* 1966, vol. 4, pp. 307–308.
*Encyclopedia of Polymer Science and Technology,* 1970, vol. 13, pp. 737, 728, 745.
"Evo-Stik 5007/2 and 5007/3 Adhesives", Evode Ltd. Evode Technical Bulletin.
"Finishing Cotton/Polyester Knits," *Textile Chemist and Colorist,* Sep. 1976, pp. 50–53 by John D. Turner, Wolfgang A. Strahl, Brian W. Jones and Wallace A. Blanton.
"For Superior Performance in Processing Equipment Specify Hemmer," Edda International Corp.
"For That Permanent Crease . . . ", *Knitting International,* Nov. 1976.
"Growth and Change in Textile Adhesives," Rohm and Haas, 7/16/76.
"How Hot Melt Adhesives are Used for Fabric Bonding," *American Dyestuff Reporter* (Mar. 1971).
"IWS's new permanent crease is inexpensive", *Bradford Telegraph & Argus,* Jul. 1, 1976.
"Lintrak Holds Crease in Clothing," *The Globe and Mail* (Jul. 31, 1976).
"Loctite Superflex RTV Silicone Sealants," *Loctite Products Technical Information.*
"Materials and Methods Used in the Production and Application of Fusible Interlinings," Cusick, *Textile Institute and Industry* (Mar. 1971).
"New Creasing Process", *Junior Age,* Aug. 1976.
"New Permanent Crease Process", *British Clothing Manufacturer,* Sep. 1976.
"New permanent crease technique from IWS", *Yorkshire Post,* Jun. 30, 1976.
"One Pack Silcoset RTV Rubbers," Dow Corning.
"Organisation & Methods", *Manufacturing Clothier,* Mar. 1976.
"Permanent crease in trousers", *Financial Times,* Jul. 15, 1976.
"Permanent trouser creasing at less than 10p a pair", *Men's Wear,* 7/8/76.
"Recent Developments in Finishing of Textiles, 5-Durable Press Finish" *Textile Dyer & Printer* (Apr. 1970).
"Recent Developments in Finishing of Textiles, 7-Durable Press Finish" *Textile Dyer & Printer* (Jun. 1970).
"Sewing Up a New Market for Glue," *Chemical Week,* Jun. 20, 1973.
"Some Fabric Properties and Their Relation to Crease-Proofing Effects," *Textile Research Laboratory,* Steele, Rohm and Haas Co., ca. 1960.
"The Attainment of Minimum-Iron Properties in Cellulosic Materials," Corteen, pp. 143–160 (Conference) ca. 1960.
"The Effect of Additives to Thermosetting Resin Baths on the Physical Properties of the Treated Fabric," *American Dyestuff Reporter,* Nov. 7, 1955, pp. 791–794.
"The Effect of Silicone Softeners on Resin Treated Cottons," *Textile Research Journal* (Jan. 1958, pp. 170–179).
"The Finishing of Wool Fabrics," IWS, *Textile Progress,* vol. 4, No. 3, 1972, Shaw and Lewis.
"The Setting of Fibres and Fabrics," Textile Book Service (1971).
"The Use of Adhesives for Durable Creasing and Seaming," 5th International Wool Textile Research Conference, vol. 111, Sep. 1975, J. D. M. Gibson, K. Houlbrook, W. V. Morgan, and B. Robinson.
"Total Fibre Finish Performance Provided by Silicone Copolymers," *International Dyer* (Dec. 19, 1969).
Why Lintrak
"Wool Printing," *International Dyer & Textile Printer* (Jan. 5, 1973).
Dow Corning Bulletin 61-006a-01, "Information about Silastic ® RTV Silicone Rubber," Jul. 1970.

*Primary Examiner*—Evan K. Lawrence

[57] ABSTRACT

A durable crease is formed in a textile article by applying a flexible casting compound in a preformed crease using a non-rotary applicator in conjunction with a structure for guiding the applicator along the crease.

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 1, lines 14–15:

This invention relates to a method of forming durable creases [and a fluid dispensing apparatus therefor].

Column 1, line 63 to Column 2, line 4:

The silicone compositions which it is preferred to apply in the process of the invention are those which cure to a soft, flexible, insoluble rubber-like material. Such compounds are commercially available for a number of end-uses, e.g. as caulking compounds. Particularly useful compounds are available under the tradenames Silastic [RTU] *RTV* (Dow Corning) or Silcoset 151, 152 and 153 (ICI). The curing of such compounds is believed to be in the nature of a chemical cross-linking and is therefore irreversible.

AS A RESULT OF REEXAMINATION, IT HAS BEEN DETERMINED THAT:

Claim 1 is determined to be patentable as amended.

New claims 2–6 are added and determined to be patentable.

1. A method for producing durable creases in a pair of trousers which comprises:

providing at least one elongated support structure of dimensions to fit within and at least the length of a trouser leg;

providing said structure, on each opposed upper and lower face, with a channel adapted to receive a preformed crease of a said trouser leg;

providing said support structure with a rotatable mounting so that the position of said faces may be reversed;

turning the pre-creased legs of a said trouser inside out and positioning one said turned leg on said structure whereby the length of the apex of the upper located creases lies within the associated channel;

*providing a dispenser device including a self-contained reservoir of a curable resin;*.

providing the dispenser head with a slot operatively conforming to the received crease of the turned leg;

operatively associating said dispenser with the positioned leg and traversing said crease to dispense said resin therein;

rotating said support structure 180° whereby to present the opposed crease to said dispenser and dispensing said resin along the length of said opposed crease;

removing said leg from the support structure; and turning said leg inside out; and folding the leg flat and curing the resin whereby to form said durable crease.

*2. A method according to claim 1 wherein said curable resin is dispensed in said crease in an amount sufficient to fill the apex of said crease to a depth of from ¼ to 2 millimeters.*

*3. A method according to claim 1 wherein said curable resin is dispensed in said crease in an amount sufficient to fill the apex of said crease to a depth of about 1 millimeter.*

*4. A method according to claim 1 wherein said curable resin is a silicone rubber.*

*5. A method according to claim 1 wherein said curable resin is a silicone rubber and is dispensed in said crease in an amount sufficient to fill the apex of said crease to a depth of from ¼ to 2 millimeters.*

*6. A method according to claim 1 wherein said curable resin is a silicone rubber and is dispensed in said crease in an amount sufficient to fill the apex of said crease to a depth of about 1 millimeter.*

* * * * *